US006801107B2

(12) United States Patent
Chen et al.

(10) Patent No.: US 6,801,107 B2
(45) Date of Patent: Oct. 5, 2004

(54) VACUUM ELECTRON DEVICE WITH A PHOTONIC BANDGAP STRUCTURE AND METHOD OF USE THEREOF

(75) Inventors: Chiping Chen, Nedham, MA (US); Michael Shapiro, Marblehead, MA (US); Jagadishwar Sirigiri, Cambridge, MA (US); Richard J. Temkin, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 220 days.

(21) Appl. No.: 10/037,661

(22) Filed: Jan. 4, 2002

(65) Prior Publication Data

US 2002/0190655 A1 Dec. 19, 2002

Related U.S. Application Data

(60) Provisional application No. 60/278,131, filed on Mar. 23, 2001.

(51) Int. Cl.[7] ..... H01P 7/00
(52) U.S. Cl. ..... 333/234; 333/235
(58) Field of Search ..... 333/234, 235

(56) References Cited

U.S. PATENT DOCUMENTS 5,973,823 A * 10/1999 Koops et al. ..... 359/322
6,134,043 A * 10/2000 Johnson et al. ..... 359/237
6,285,020 B1 * 9/2001 Kim et al. ..... 250/216
6,452,713 B1 * 9/2002 White ..... 359/322
6,535,665 B1 * 3/2003 Kim et al. ..... 385/28
6,538,621 B1 * 3/2003 Sievenpiper et al. ..... 343/909
6,603,558 B2 * 8/2003 Murakowski et al. ..... 356/461

OTHER PUBLICATIONS

Patent Cooperation Treaty (PCT) International Search Report; International application No. PCT/US02/18750; mailed Oct. 29, 2003.

Shapiro, M. A. et al., "17 GHz photonic band gap cavity with improved input coupling," Physical Review Special Topics—Acceleration and Beams, 4, 2001, pp. 042001/1–042001/6.

Smirnova, E. I. et al., "Simulation of photonic band gaps in metal rod lattices for microwave applications," Journal of Applied Physics, 91, No. 3, Feb. 1, 2002, pp. 960–968.

Biller et al., "Poisson/Superfish User's Manual," *Los Alamos Accelerator Code Group* (LANL, 1996).

(List continued on next page.)

*Primary Examiner*—Patricia Nguyen
(74) *Attorney, Agent, or Firm*—Testa, Hurwitz & Thibeault

(57) ABSTRACT

A vacuum electron device with a photonic bandgap structure that provides the ability to tune the behavior of the device to a particular mode of a plurality of modes of propagation. The photonic bandgap structure comprises a plurality of members, at least one of which is movable, and at least one of which is temperature controlled. The photonic bandgap structure makes possible the selection of one mode of propagation without the necessity to build structures having dimensions comparable to the wavelength of the propagation mode.

12 Claims, 13 Drawing Sheets

OTHER PUBLICATIONS

Gelvich et al., "The New Generation of High–Power Multiple–Beam Klystrons," *IEEE Transactions on Microwave Theory and Techniques*, vol. 41, p. 15 (1993).

Plasma Science and Fusion Center—MIT "Gyrotron Oscillator with a Photonic Bandgap Resonator" (2001).

Radisic et al., "Broad–Band Power Amplifier Using Dielectric Photonic Bandgap Structure," *IEEE Microwave and Guided Wave Letters*, vol. 8, p. 13 (1998).

Shapiro et al., "Improved Photonic Bandgap Cavity and Metal Rod Lattices for Microwave and Millimeter Wave Applications," *IEEE MTT–S Digest*, p. 581 (2000).

Shapiro et al., "Photonic Bandgap Structure Based Accelerating Cell," *Proceedings of the 1999 Particle Accelerator Conference*, p. 833 (1999).

Shapiro et al., "Photonic Bandgap Structures—Oversized Circuits for Vacuum Electron Devices," *IEEE Electron Devices Society* (2000).

Shapiro et al., "Photonic Bandgap Structures: Oversized Circuits for Vacuum Electron Devices," *Presented at IVEC* (2000).

Sirigiri et al., "A Photonic Bandgap Resonator Gyrotron," *Phys. Rev. Lett.*, vol. 86, p. 5628 (2001).

Sirigiri, "Gyrotron Research Scenario," *Varanasi* (2001).

Sirigiri et al., "High Power W–Band Quasioptical Gyrotron Research at MIT," *Varanasi* (2001).

Sirigiri, "Results on Gyrotron Research with Overmoded Resonators," *MURI Student Teleconference* (2001).

Smith et al., "Studies of a Metal Photonic Bandgap Cavity," *AIP Conference Proceedings 335*, p. 761, (1995).

Sun et al., "Grid Oscillators with Selective–Feedback Mirrors," *IEEE Transactions on Microwave Theory and Techniques*, vol. 46, p. 2324 (1998).

UCD Plasma Physics and Millimeter Wave Technology Group "Innovative Vacuum Electronics Brief Program Description," http://tempest.engr.ucdavis.edu/muri99/overview.html (2 pgs.).

* cited by examiner

VACUUM ELECTRON DEVICE WITH A PHOTONIC BANDGAP STRUCTURE AND METHOD OF USE THEREOF

CROSS-REFERENCE TO RELATED APPLICATIONS

This application claims the benefit of U.S. provisional patent application Ser. No. 60/278,131, filed Mar. 23, 2001, which application is incorporated herein in its entirety by reference.

GOVERNMENT RIGHTS

This invention was made with government support under Grant No. F49620-99-0197 and Grant No. F49620-01-0007 awarded by the United States Air Force Office of Scientific Research. The government may have certain rights in the invention.

FIELD OF THE INVENTION

This invention relates generally to vacuum electron devices. More particularly, the invention relates to vacuum electron devices that comprise a photonic bandgap (PBG) structure.

BACKGROUND OF THE INVENTION

Vacuum electron devices or microwave tubes are important sources of high power microwave radiation for use in industrial heating, plasma heating, radar, communications, accelerators, spectroscopy and many other applications. Extension of the operating frequency of these sources to higher frequency is of great interest and would open up many new applications. Obstacles exist to the extension of the operating frequency.

First, as the frequency increases to the millimeter wave range, cavities operating in the fundamental mode of a waveguide (rectangular or circular, for example) require dimensions of less than the wavelength so that accurate fabrication is difficult and expensive. Dimensions of less than a millimeter are not uncommon. Second, the heat load per unit area on resonator walls becomes excessive at high power in such resonators. Third, it can become difficult to pass electron beams through small structures without beam interception.

The use of overmoded cavities has been attempted to alleviate the problems of excessive heating and difficulty of fabrication. However, the small spacing between modes in conventional overmoded cavities leads to mode competition. Mode competition is a limiting factor in the design and operation of gyrotron amplifiers and oscillators operating in the millimeter wave band. It is also a serious obstacle to building conventional slow wave devices such as traveling wave tubes and klystrons with overmoded structures in the microwave and millimeter wave band. Indeed, the beam tunnel in a high-power periodic permanent magnet (PPM) focusing klystron amplifier is typically designed to provide cutoff at the second harmonic in order to prevent self-oscillation.

SUMMARY OF THE INVENTION

The vacuum electron device with a PBG structure can include a PBG structure that is capable of overmoded operation, as well single mode operation. PBG structures are, in some embodiments, two-dimensional (2D) or three-dimensional (3D) periodic structures with restricted transmission bands at certain frequencies. Such vacuum electron devices include gyrotron oscillators and amplifiers, traveling wave tubes, traveling wave tube amplifiers, klystrons, microwave tubes, and the like. The device with the PBG structure can include a single cavity, or the device can include a plurality of cavities. The PBG structure permits the device to operate more efficiently.

PBG cavities offer several advantages, including, but not limited to, an oversized structure that offers ease of fabrication; a structure that is suitable for high frequency operation; and a structure that can include an absorbing peripheral boundary. PBG structures can be used to provide higher order mode discrimination. Coupling into a PBG cavity can be performed using a variety of coupling schemes, and the coupling can be optimized. Coupling into a PBG cavity in some embodiments involves distributed coupling. Distributed coupling results in relatively small disturbance of the resonant mode frequency when compared with conventional hole coupling.

In one aspect, the invention relates to a tunable photonic bandgap structure, comprising a photonic bandgap structure having a plurality of members, at least one member of which is movable. In one embodiment, at least one of the plurality of movable members comprises a rectilinear structure.

In another aspect, the invention features a temperature-controlled photonic bandgap structure, comprising a photonic bandgap structure having a plurality of members, at least one member of which is temperature controlled. In one embodiment, at least one temperature-controlled member comprises a surface that is temperature controlled by contact with a fluid.

In another aspect, the invention concerns a tunable, temperature controlled photonic bandgap structure, comprising a photonic bandgap structure having a plurality of members, wherein at least one member is movable, and wherein at least one member is temperature controlled. In one embodiment, the photonic bandgap structure comprises the plurality of members disposed in a multi-dimensional array. In one embodiment, the multi-dimensional array is a periodic array.

In yet another aspect, the invention relates to an apparatus for providing mode-selected microwave radiation. The apparatus comprises a vacuum electron device microwave generator creating microwave radiation having a plurality of modes, and a temperature controlled photonic bandgap structure in communication with the vacuum electron device microwave generator. The PBG receives the microwave radiation and selects one of the plurality of modes of the microwave radiation to be propagated. The photonic bandgap structure comprises a plurality of members disposed in a two-dimensional array wherein at least one member is temperature controlled.

In a still further embodiment, the invention features an apparatus for providing mode-selected microwave radiation. The apparatus comprises a vacuum electron device microwave generator creating microwave radiation having a plurality of modes, and a tunable photonic bandgap structure in communication with the vacuum electron device microwave generator. The PBG receives the microwave radiation and selects one of the plurality of modes of the microwave radiation to be propagated. The photonic bandgap structure comprises a plurality of members disposed in a two-dimensional array wherein at least one member is movable.

In a further aspect, the invention relates to an apparatus for providing mode-selected microwave radiation. The apparatus comprises a vacuum electron device microwave generator creating microwave radiation having a plurality of modes, and a tunable photonic bandgap structure in communication with the vacuum electron device microwave generator to receive the microwave radiation and to select one of the plurality of modes of the microwave radiation to be propagated, the photonic bandgap structure comprising a plurality of members disposed in a two-dimensional array wherein at least one member is movable, and wherein at least one member is temperature controlled.

In yet another aspect, the invention features an apparatus for providing mode-selected microwave radiation. The apparatus comprises a microwave generator means for creating microwave radiation having a plurality of modes, and a temperature controlled photonic bandgap means for receiving the microwave radiation and for selecting one of the plurality of modes of the microwave radiation to be propagated, the temperature controlled photonic bandgap means in communication with the microwave generator means.

In a still further aspect, the invention is involved with an apparatus for providing mode-selected microwave radiation. The apparatus comprises a microwave generator means for creating microwave radiation having a plurality of modes, and a tunable photonic bandgap means for receiving the microwave radiation and for selecting one of the plurality of modes of the microwave radiation to be propagated, the tunable photonic bandgap means in communication with the microwave generator means.

In one aspect, the invention features the devices themselves including the PBG structure. In another aspect, the invention relates to the methods of use of the devices with the PBG structure. In a further aspect, the invention features methods of manufacturing the devices with the PBG structure. In yet a further aspect, the invention relates to methods of simulating the PBG structure and simulating the behavior of the PBG structure.

In some embodiments, the PBG structure enables the device to handle higher powers and to have a larger size than a similar device without a PBG structure. In some embodiments, the PBG structure provides features such as filtering, amplification, and mode selection. In some embodiments, the PBG structure is an all-metal structure. In an alternative embodiment, the PBG structure is a structure that comprises both metals and dielectric materials. The PBG structure can have a plurality of members, such as cylindrical metal rods disposed axially therein. The members are movable, and can extend along the axial direction for a fixed distance, or can extend along the axial direction for a distance that can be varied. The members can be disposed in an array on a plane perpendicular to the axial direction. One or more of the members can be removed from the array to introduce a defect into the PBG structure. In some embodiments, the PBG structure enables a relaxation of the structural and mechanical precision otherwise needed in fabricating operational devices. In one embodiment, the members, for example, metal rods, can be temperature controlled by flowing a fluid, such as water, therethrough.

In some aspects, the invention relates to a method of modeling a PBG structure. The method includes the use of a finite element computer code for calculating eigenmodes in periodic metallic structures, including 2D and 3D structures. The modeling method includes calculations for the determination of the bulk properties of wave propagation in PBG structures, and calculations of the eigenmodes that appear in PBG cavities.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

One approach to overcome the problem of mode competition in overmoded structures is the use of PBG cavities. A PBG structure, which is a periodic array of spatially varying dielectric or metallic structures (or combinations of metallic and dielectric structures), was first described by Yablonovitch. In recent years, numerous advances have improved the understanding of the theory of PBG structures. This has led to new applications in passive devices for guiding and confinement of electromagnetic radiation. The use of PBG structures in both microwave and optical devices has primarily been limited to passive devices such as waveguides and filters, though some applications in active devices have been reported.

Figure 1A:
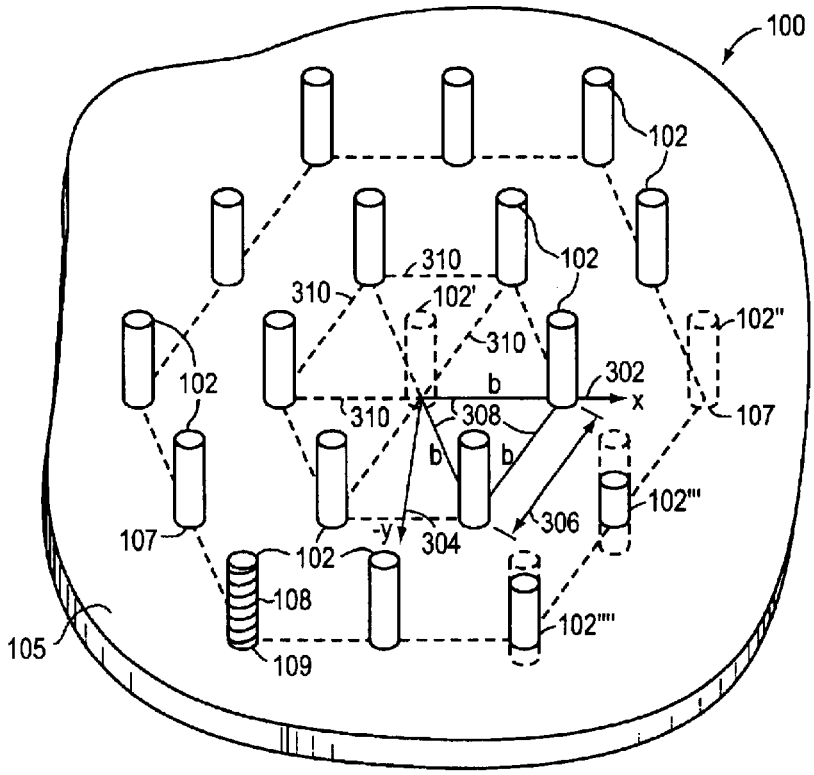
FIG. 1A is a drawing showing a perspective view of an illustrative embodiment in the form of a triangular (or hexagonal) symmetry photonic bandgap cavity comprising a plurality of movable and temperature-controlled members, according to principles of the invention.

FIG. 1A is a drawing showing a perspective view of an illustrative embodiment in the form of a triangular (or hexagonal) symmetry photonic bandgap cavity 100 comprising a plurality of movable and temperature-controlled members 102, disposed in a supporting structure, such as baseplate 105. The baseplate 105 can be made of metal. In one embodiment, the members 102 are metallic right circular cylinders. In other embodiments, the members 102 are rectilinear structures such as fingers having polygonal cross section, for example, triangles, squares, hexagons, octagons, and the like. A two-dimensional (2D) PBG cavity 100 made of a lattice (or array) of members 102 with a defect (i.e., a missing member 102' or several missing members 102) in the center is used in a variety of microwave tubes, such as klystrons and coupled cavity traveling wave tubes (TWT). For the configuration shown in FIG. 1A, a defect mode of the lattice is used as an operating mode. The defect is provided by the deliberate removal (or deliberate failure to provide) a member 102', shown in phantom, at one triangular vertex of the array. This defect mode is analogous to the $TM_{010}$ mode of a pill-box cavity. The advantage of the PBG cavity 100 is that only the operating mode is localized in the vicinity of the defect. Higher-order high-frequency modes penetrate through the rows of members 102 and therefore can be damped (or spilled over) without affecting the operating mode. Thus, this cavity 100 is capable of suppressing unwanted modes. In addition, the rf coupling into the operating mode is improved because the coupling is distributed over the members 102, yielding a more symmetric field distribution in comparison with direct waveguide coupling.

The PBG cavity 100 can be tuned, for example by removal or by partial withdrawal of individual members 102. The tuning can be simulated by computations, as discussed in greater detail below. In addition, the coupling of the cavity 100 can be adjusted to achieve critical coupling. Adjustments can include changes in the direction of propagation of the electromagnetic radiation relative to the geometry of the PBG, as well as changes in the number of members 102 present in the PBG and changes in the length of one or more members 102 within the PBG. The changes can be performed dynamically during the operation of the PBG, or the changes can be performed with the PBG in a non-operating condition, or both sequentially.

In particular, the illustrative embodiment shown in FIG. 1A comprises two hexagons of members 102 (e.g., metal rods or rectilinear fingers) surrounding the central defect (e.g., the missing member 102' in the center of the 2D array). In this embodiment, the innermost hexagon comprises six (6) members 102. The next hexagon comprises twelve (12) locations that are potentially the sites at which members 102 are present.

As can be seen in FIG. 1A, the majority of members 102 are rectilinear structures that extend a fixed distance above the baseplate 105. The member 102" has been withdrawn to the extent of substantially 100 percent of its length in the PBG (e.g. removed entirely), as indicated by the phantom 102" shown in outline. This withdrawal can be accomplished by moving the member 102 slidably through a bore 107 in the baseplate 105, and holding the member 102 in a specific position by clamping the member 102, for example with a set screw (not shown) that extends against the member 102 in the plane of the baseplate 105. Alternatively, the member 102 can have a thread 108 on its outer surface, which mates with an internally threaded bore 109 through the baseplate 105, so that the member 102 can be advanced into or withdrawn from the PBG by being rotated, thereby activating an axial motion as the screw thread 108 turns. The member 102'" has been withdrawn to the extent of approximately 66% of its extension in the PBG, while the member 102"" has been withdrawn only a modest amount.

FIG. 1A further includes an illustrative diagram that shows the geometry of a triangular (or hexagonal) two-dimensional (2D) photonic bandgap lattice. In FIG. 1A, the directions of the x 302 and negative y 304 vectors defining the basis vectors of the two dimensional array are shown. Since the lattice or array of FIG. 1A is a triangular or hexagonal lattice, the distance between centers of adjacent rods 102 or fingers is the distance b 306, that is, the centers of three rods 102, here indicated as being connected by solid lines 308, form an equilateral triangle which is a triangular "unit cell" of the array. The dotted parallelepiped comprising dotted lines 310 located with one of its vertices at the origin (x=0, y=0) indicates the hexagonal "unit cell" of the lattice. One can recognize the hexagonal nature of the lattice by considering all of the locations of rods or rectilinear fingers other than the one at the origin. In this diagram, the x 302 axial direction corresponds to one of several possible vertex coupling directions, and the negative y 304 axial direction corresponds to one of several possible side coupling directions.

Figure 1B:
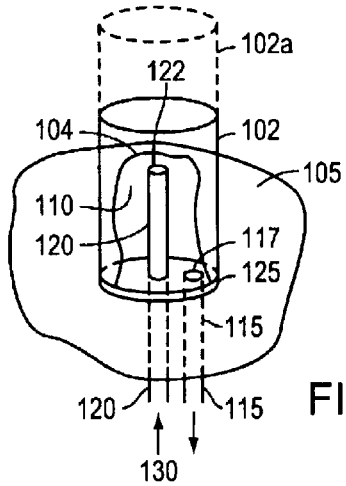
FIG. 1B is a drawing showing in cutaway cross-section a structure useful for controlling the temperature of movable members, according to principles of the invention.

FIG. 1B is a drawing showing in cutaway cross-section a structure useful for controlling the temperature of movable members 102. The member 102 is shown in cutaway section, and plate 105 is indicated as a plane surface. The cutaway line 104 allows the viewer to see the interior of the member 102. The member 102 has interior surfaces or walls 110, and an interior upper surface, not seen. A tubulation 120, such as a hose, enters the interior of the member 102 through an opening in the bottom surface 125 of the member 102. Cooling fluid 130 provided by a source (not shown) flows up through tubulation 120 and exits its open end 122, flowing within the interior walls 110 of member 102 so as to control the temperature of the member 102 by conduction. The fluid 130 can be water. The fluid temperature is regulated by standard means to provide adequate heating or cooling to control the temperature of the member 102. A tubulation 115 for removing the fluid from the interior of the member 102 is provided. The tubulation 115 penetrates the bottom surface 125 of the member 102 to provide egress at an opening 117 defined within the bottom surface 125 from the interior volume within the member 102. As can be seen with regard to the member 102 and the phantom 102*a*, the member 102 can be both movable and temperature-controlled. Temperature control is useful to permit operation of the PBG structure at high power without damage.

RF waves propagating in a 2D periodic array of perfect conductors were studied for square lattices (see FIG. 2A) and triangular (or hexagonal) lattices (see FIG. 4). FIG. 2A is an illustrative diagram that shows the geometry of a square two-dimensional (2D) photonic bandgap lattice. In FIG. 2A, the directions of the x 202 and y 204 vectors defining the basis vectors of the two dimensional array are shown. Since the lattice or array of FIG. 2A is a square lattice, the distance between centers of adjacent rods 102 or fingers is the distance b 206 in both the x and y directions. The dotted square 208 located with its center at the origin (x=0, y=0) that encloses the central member 102 of the array indicates the "unit cell" of the lattice.

Figure 2B:
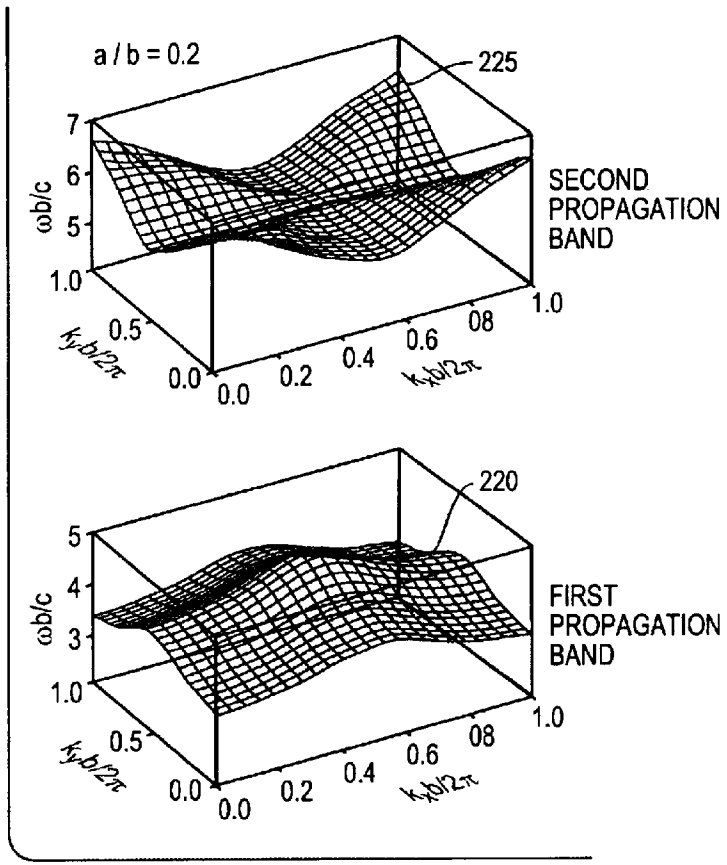
FIG. 2B is a diagram showing two-dimensional plots of the normalized frequency $\omega b/c$ versus normalized wave vector ($k_x b/2\pi$, $k_y b/2\pi$) for the first- and second-propagation bands of a square 2D lattice calculated using a/b=0.2, which plots indicate the presence of a photonic bandgap.
Figure 2A:
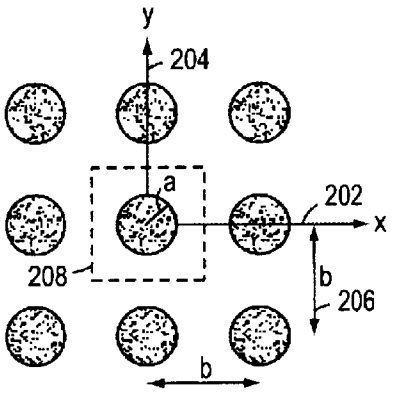
FIG. 2A is an illustrative diagram that shows the geometry of an embodiment of a square two-dimensional (2D) photonic bandgap lattice having members with radius a and lattice spacing b.

FIG. 2B is a diagram showing two-dimensional plots of the normalized frequency ωb/c versus normalized wave vector ($k_x b/2\pi$, $k_y b/2\pi$) for the first propagation band 220 and second-propagation band 225 of a square 2D photonic bandgap lattice calculated using a/b=0.2. The plots indicate the presence of a photonic bandgap which is seen more clearly in FIG. 2C.

Figure 2C:
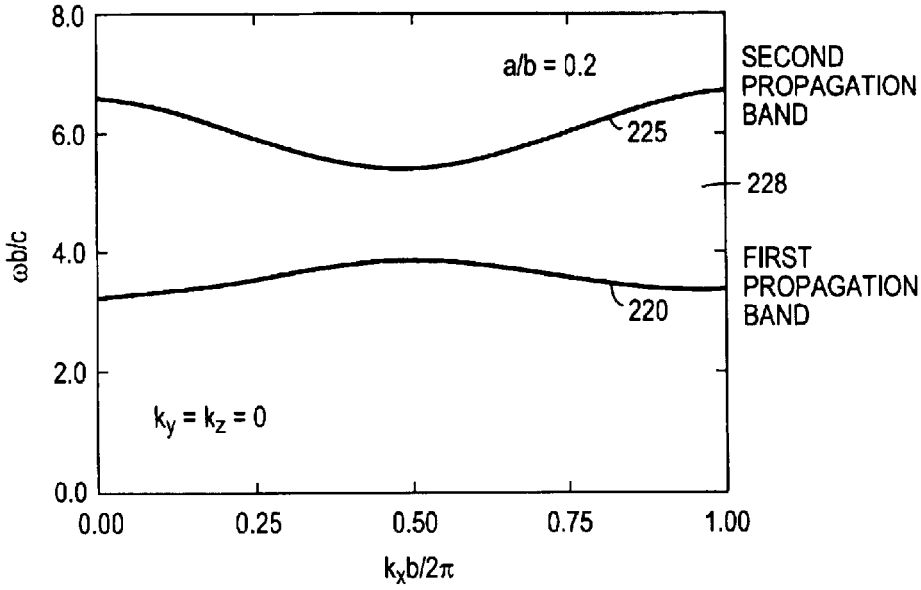
FIG. 2C is a diagram that shows an illustrative Brillouin diagram calculated for a TM mode of an exemplary square array 2-D PBG cavity, according to principles of the invention.

FIG. 2C is a diagram that shows an illustrative Brillouin diagram calculated for a TM mode of an exemplary square array PBG cavity. A Brillouin diagram is a graphical representation of the dispersion relation for the PBG structure, as is understood by those skilled in the theoretical aspects of the PBG arts. The calculation represented by FIG. 2C was performed using the parameters $k_y=k_x=0$ and a/b=0.1 The Brillouin diagram of FIG. 2C shows the presence of a photonic bandgap 228 everywhere in the unit cell as viewed along the x direction between the first propagation band 220 and the second propagation band 225.

Figure 2D:
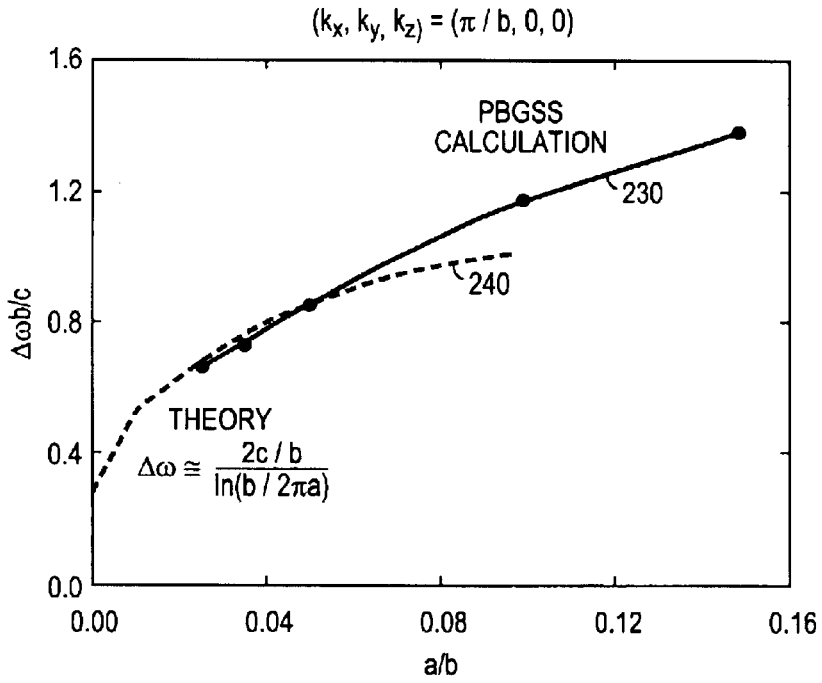
FIG. 2D is a diagram that shows the normalized bandgap width $\Delta\omega b/c$ vs. a/b calculated for a TM mode of an illustrative square array PBG cavity using the PBGSS calculation and the same curve as theoretically derived, according to principles of the invention.

FIG. 2D is a diagram that shows the normalized bandgap width Δωb/c vs. a/b calculated for a TM mode of an illustrative square array PBG cavity using the PBGSS calculation (curve 230) and the curve 240 derived using quasi-static theory. A wave vector with ($k_x$, $k_y$, $k_z$)=(π/b,0,0) and small values of a/b are represented. The PBGSS calculations are in good agreement with the quasi-static theory, which is valid for a/b<0.05.

Figure 3:
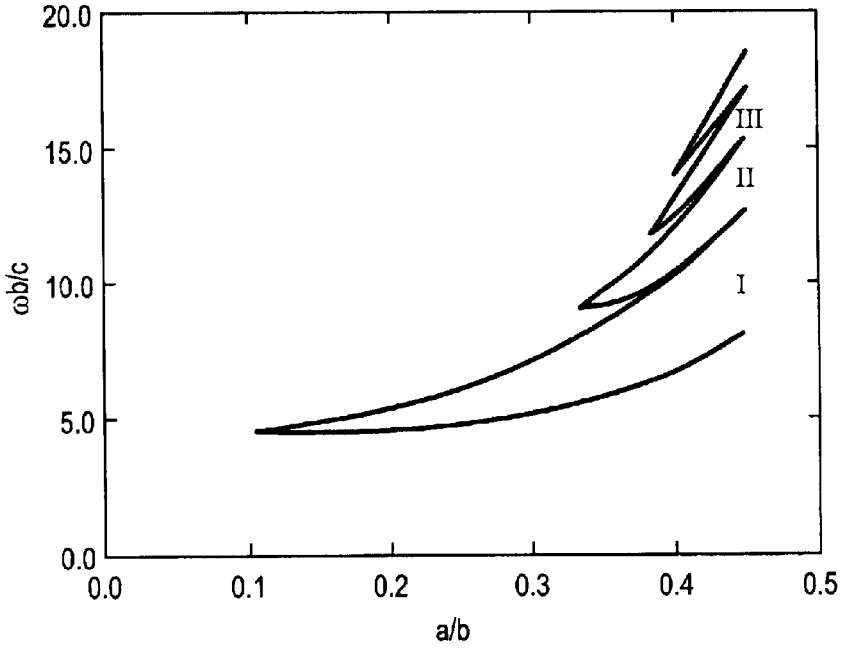
FIG. 3 is a diagram of calculated global bandgaps for the TM polarization in a series of illustrative 2D square lattices of metal members, in which the range of normalized frequencies ($\Omega=\omega b/c$) is plotted as a function of the ratio of rod radius to lattice spacing ($\alpha=a/b$), according to principles of the invention.

The 2D square and triangular lattices fabricated with cylindrical metal members were investigated analytically and computationally. An electromagnetic code, named Photonics Bandgap Structure Simulator (PBGSS), was developed to calculate the dispersion characteristics of 2D metal rod lattices. The square 2D lattices were analyzed to determine the propagation bands and the stop bands (bandgaps). An analytical model based on the quasi-static approximation was applied for a member diameter that is small compared with the wavelength. FIG. 3 is a diagram 400 of global bandgaps in 2D square lattices of cylindrical metal members, in which the range of normalized frequencies (Ω=ωb/c) is plotted vs. the ratio of member radius to lattice spacing (α=a/b).

The results of calculation of bandgaps are plotted in FIG. 3 for the TM polarization (electric field is along the members). The calculations were made for different ratios α(=a/b). The first (I) and higher order (II, III) bandgaps are shown as the range of normalized frequencies Ω(=ωb/c) where c is the speed of light. The second bandgap (II) is shown only for α>0.35, and the third bandgap (III) for α>0.40. It is shown in FIG. 3 that global bandgaps exist in a 2D square lattice of cylindrical metal members for $\alpha>\alpha_{cru}=0.1$.

Within the array of conductors, the system is fully specified by the conductivity profile, $$\sigma(x)=\sigma(x\perp)=\begin{cases}\infty, & \left(x-\left(n+\frac{m}{2}\right)b\right)^2+\left(y-\frac{\sqrt{3}}{2}mb\right)^2<a^2\\ 0, & \text{otherwise}\end{cases} \tag{2}$$

for a square lattice, and $$\sigma(x)=\sigma(x\perp)=\begin{cases}\infty, & (x-nb)^2+(y-mb)^2<a^2\\ 0, & \text{otherwise}\end{cases} \tag{1}$$

for a triangular lattice, where (x, y) are the transverse coordinates, $x\perp=x\hat{e}_x+y\hat{e}y$, α is the radius of the metal member, b is the spacing of the two-dimensional array, n and m are integers. The conductivity profile$\sigma(x\perp)$ satisfies the periodic condition:

$$\sigma(X_\perp+T)=\sigma(x_\perp)$$

where $T=nb\hat{e}_x+m\hat{e}_y$ for the square lattice and $T=(n+m/2)b\hat{e}_x+\sqrt{3}/2\ mb\hat{e}_y$ for the triangular lattice.

The wave field in a PBG structure can be decomposed into two independent classes of modes, namely, the transverse electric (TE) mode and the transverse magnetic (TM) mode. For simplicity, a single frequency wave with fixed longitudinal propagation constant traveling through the lattice is considered, because every wave in this structure can be expressed as a series of such basis waves.

Maxwell's equations permit all the components of the electric and magnetic fields to be found for a given axial component of the electric field in a TM mode or of the magnetic field in a TE mode. This component is denoted by:

$$\psi(x,t)=\psi(x_\perp,t)e^{i(k_z z_{Z-\omega t})} \tag{3}$$

where ω is the angular frequency of the wave, and $k_z$ is its longitudinal propagation constant in the Z direction, which is normal to the x-y plane. The Helmholtz wave equation for ψ(x⊥) can be derived from Maxwell's equations, i.e., $$\nabla_\perp^2\psi(x_\perp)=\left(k_z^2-\frac{\omega^2}{c^2}\right)\psi(x_\perp) \tag{4}$$

The boundary conditions are:

$$(\psi)_s=0 \qquad \text{(TM Mode)}$$

$$\left(\frac{\partial\psi}{\partial n}\right)_2=0 \tag{5}$$

where S denotes the surface of the conducting poles, and n is the vector normal to the surface.

According to the Floquet Theorem, the wave field in a periodic structure satisfies the condition:

$$\psi(x_\perp)_{-}u(x_\perp)e^{ik_\perp}{}_{-T} \tag{6}$$

where u(x⊥+T)=u(x⊥), and $k\perp=k_x\hat{e}_x+k_y\hat{e}_y$ is an arbitrary transverse wave vector. To find the field in the lattice structure, we need to solve equation (4) inside one elementary cell and satisfy the boundary conditions:

$$\psi(x_\perp T)=\psi(x_\perp)e^{ik_\perp \cdot T}. \tag{6a}$$

Figure 4A:
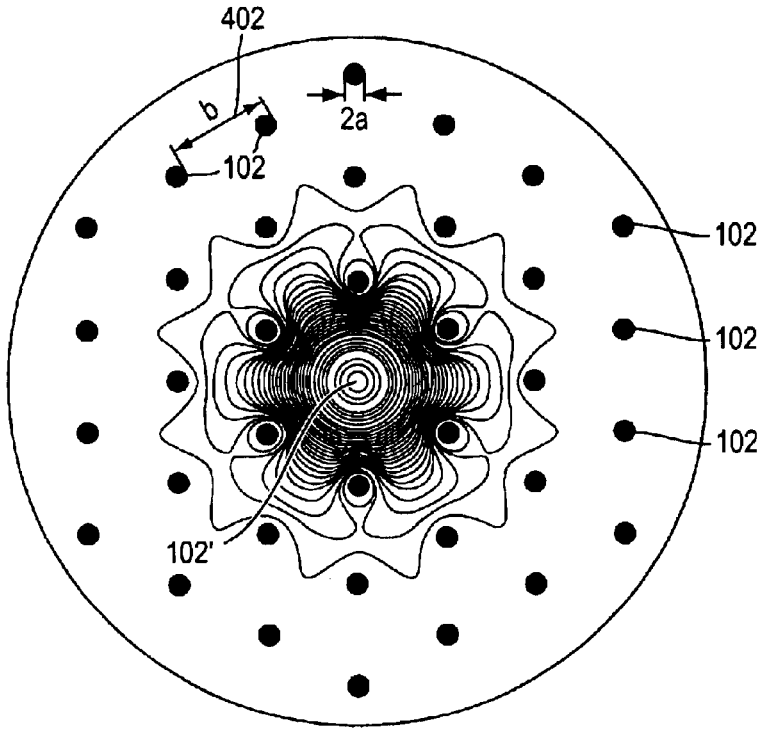
FIG. 4A is a diagram that shows constant electric field contours calculated in the 17 GHz SUPERFISH simulation of an illustrative triangular photonic bandgap cavity geometry of one embodiment of the inventions.

The results of the electromagnetic code were verified using the SUPERFISH eigenmode solver, which was written at the Los Alamos National Laboratory (LANL), and is available at no cost from the web site http://laacgl.lanl.gov/laacg/services/psugall.html. Good agreement was found between analytical calculations and simulations for $\alpha<0.10$. FIG. 4A is a diagram that shows constant electric field contours calculated in the 17 GHz SUPERFISH simulation of an illustrative triangular photonic bandgap cavity geometry. The cavity 100 is formed of a lattice of conductive members 102 with a defect 102' in the center. In the diagram of FIG. 4A, the radius of a member 102 is expressed as the quantity a, and the center-to-center spacing of adjacent members 102 is expressed as the quantity b 402.

The SUPERFISH code was also employed to calculate the eigenmodes and eigenfrequencies of a 17 GHz PBG cavity 100. Using the data from the SUPERFISH simulations, the ohmic Q-factor and the shunt impedance of the PBG cavity 100 were calculated. The dimensions of the cavity 100 and the simulation results are shown in Table 1. The lines of constant axial electric field deduced in the simulation of the PBG cavity 100 are shown in FIG. 4A.

TABLE 1

Parameters of the 17 GHz PBG cavity.

| Parameter | | Value |
|---|---|---|
| Lattice spacing, b | | 0.64 cm |
| Rod radius, a | | 0.079 cm |
| Cavity radius | | 2.15 cm |
| Calculated Eigenfrequency | | 17.32 GHz |
| Axial length | | 0.787 cm |
| Ohmic Q-Factor | | 5200 |
| Shunt impedance | | 2.1 MΩ/cm |
| Calculated Coupling Frequency | SUPERFISH: | 17.32 GHz |
| | HFSS: | 17.24 GHz |

Figure 4B:
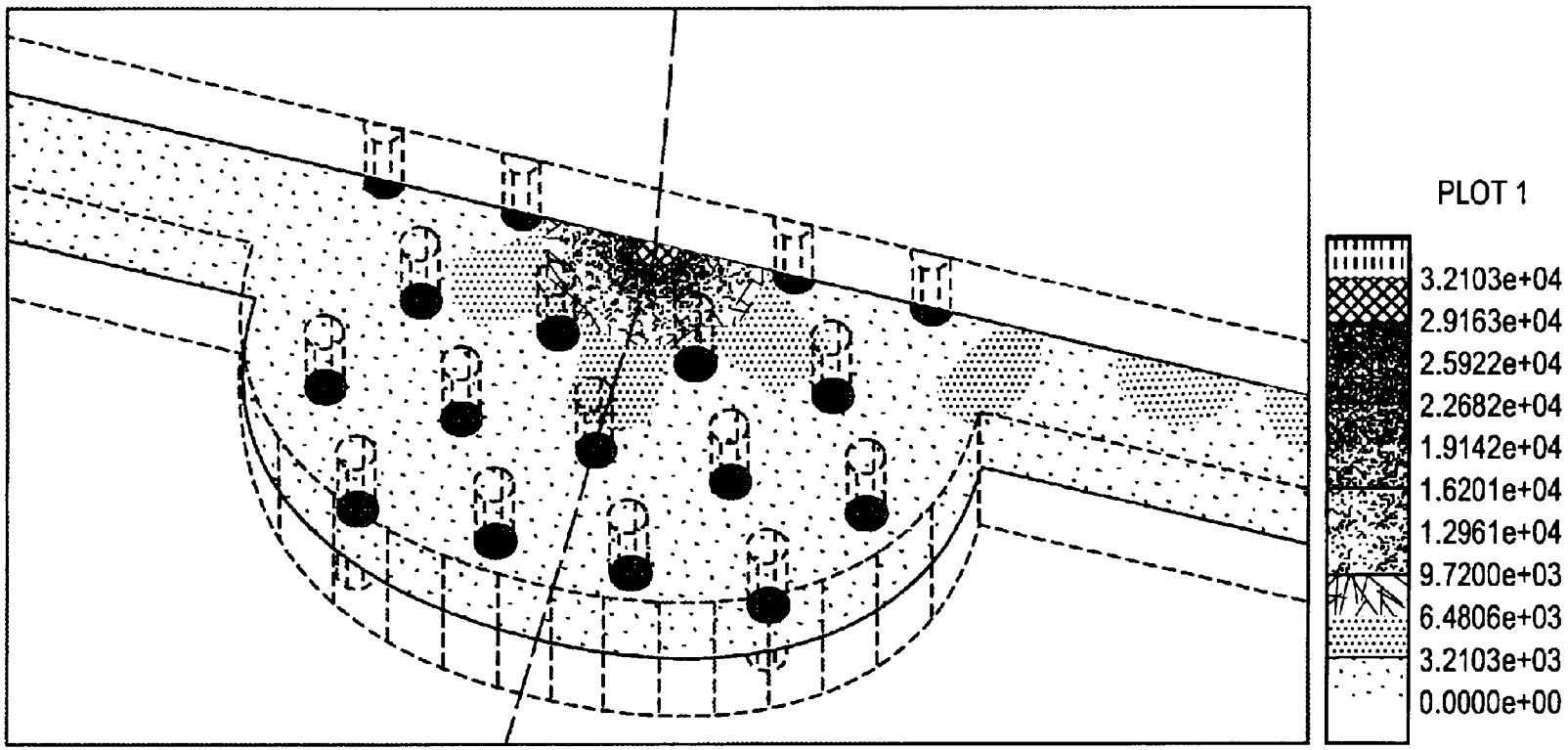
FIG. 4B is a diagram that shows the 17 GHz HFSS simulation of RF coupling to the illustrative triangular photonic bandgap cavity geometry of one embodiment of the invention.

FIG. 4B is a diagram that shows the HFSS simulation of RF coupling to the illustrative triangular photonic bandgap cavity 100 geometry of one embodiment of the invention.

The 17 GHz PBG cavity 100 was fabricated using a brass container with copper wires as the members. The movable members were fitted into holes in the brass covers. The copper wires were not brazed so they could be removed during the cold test.

A vector network analyzer (VNA) was employed to characterize the 17 GHz PBG cavity 100. The $S_{11}$ element of the scattering matrix was measured with the VNA. In the cold test, two orientations of the waveguide ports were used with respect to the hexagon formed by the first row of the rods:.

Figure 5:
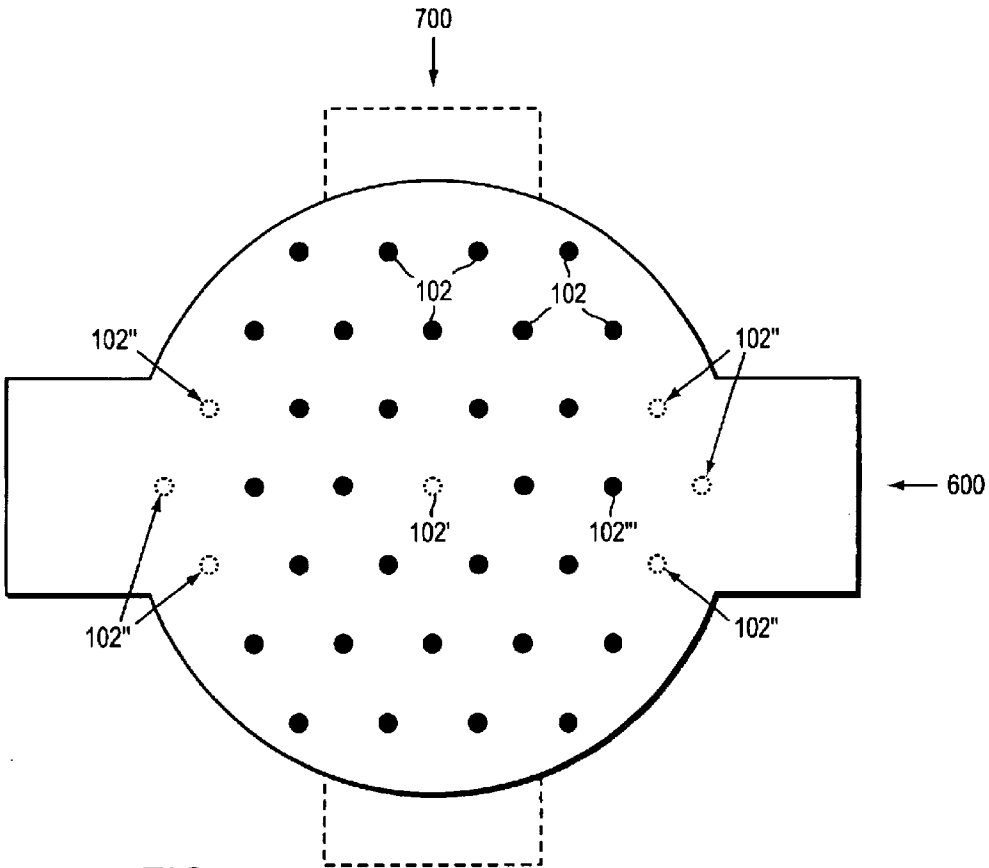
FIG. 5 shows a schematic diagram illustrating embodiments employing vertex coupling and side coupling into the photonic bandgap cavity at 17 GHz, according to principles of the invention.

FIG. 5 shows a schematic diagram illustrating an embodiment employing vertex coupling 600 and an embodiment employing side coupling 700 (shown in phantom) into the photonic bandgap cavity 100. In other embodiments, the electromagnetic radiation is directed toward the PBG structure at an angular direction relative to one or more linear rows of members 102. In the vertex coupling scheme (or the vertex coupling orientation), the electromagnetic radiation impinges on the PBG structure in an orientation at an angle of substantially 60 degrees, or substantially 120 degrees if viewed as coming from the opposite direction, to two linear rows of members 102 that comprise adjacent sides of the hexagonal array (e.g., upon a vertex of the hexagon). In side coupling 700, shown in phantom, the radiation impinges substantially perpendicular to a row of members 102. In principle, the electromagnetic radiation can impinge on the 2D PBG cavity 100 at any angle relative to the orientation of the array of members 102.

In FIG. 5, the rods 102" at positions indicated by open circles are removed, the rods 102'" indicate rods which are partially withdrawn in some of the observations, and the remaining rods 102 extend their full length in the cavity 100 for the mode of interest. The central rod 102' is removed to introduce the defect mode, and is shown as an open circle in FIG. 5. The measured $S_{11}$ frequency dependence in the vertex coupling geometry with all rods fully inserted on the PBG cavity is shown as the curve 805 in FIG. 6A. The resonant frequency agrees relatively well (within 0.02%) with the frequency predicted by SUPERFISH (see Table 1).

Ansoft High Frequency Structure Simulator (HFSS), a commercially-available 3D electromagnetic code, is used to model the experiment. Using HFSS, the $S_{11}$ frequency dependence was calculated including ohmic losses in the cavity 100. The loaded and ohmic Q-factors of the PBG cavity 100 were determined from the $S_{11}$ curves. For the vertex coupling scheme, the measured ohmic Q-factor was 900, which was half of that obtained from HFSS simulations. The reason for the low Q was that the rods were not brazed to the brass covers of the cavity 100. An improvement in Q may be obtained by providing a secure electrical connection between each movable member 102 or rectilinear finger and the brass cover with a conductive strap, such as a length of copper braid. The conductive strap is brazed or connected with a screw connection to a member 102 at one end, and brazed or otherwise connected to the brass cover at the other end. A conductive strap provides good electrical contact while permitting relative motion between the member 102 and the cover. An alternative approach is to thread the member 102, and to tap the opening in the cover into which the member 102 is placed, again providing good electrical contact while allowing the member 102 to be moved relative to the cover by rotating the member 102. The computational results are shown as curve 810 of FIG. 6A.

Figure 6B:
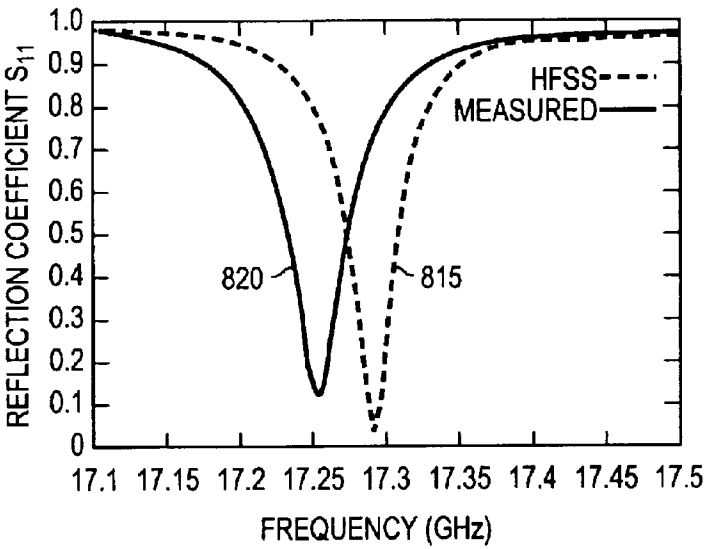
FIGS. 6A and 6B show diagrams of the measured $S_{11}$ frequency dependence in the vertex coupling embodiment as a function of tuning and the frequency predicted by HFSS simulation, according to principles of the invention.

The side coupling scheme demonstrated about the same performance as the vertex coupling scheme. In both vertex and side coupling schemes, the PBG cavity 100 was undercoupled. Coupling correction could be made by partially withdrawing members from the second row. For example, one member 102'" on each side of the cavity 100 was partially removed in the vertex coupling scheme of FIG. 5 to reach critical coupling. Critical coupling was observed experimentally in cold test and confirmed by the HFSS simulation as shown in FIG. 6B. The measured ohmic Q-factor was 600 at the critical coupling. In the side coupling embodiment, two members 102'" at each side of the PBG cavity 100 were partially withdrawn to reach critical coupling.

FIG. 6B shows the actual 905 and calculated 910 frequency dependence of reflectivity $S_{11}$ in the vertex coupling geometry of FIG. 5 with the rods 102'" partially withdrawn from the PBG cavity 100. Comparison of FIGS. 6A and 6B indicates that the reflection coefficient $s_{11}$ can be varied by changing the positions of rods 102 within the cavity, e.g., the propagation characteristics of the cavity can be tuned by changing the extension of various fingers within the cavity.

Figure 6A:
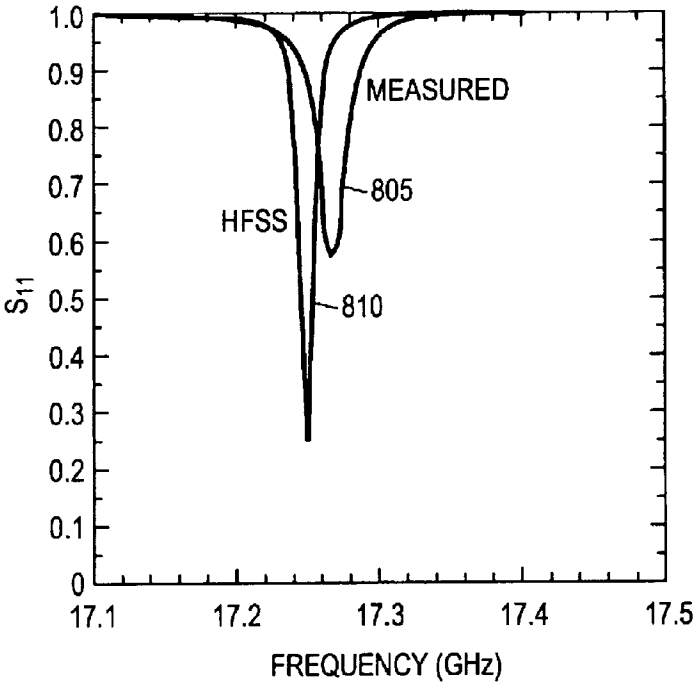

As indicated by FIGS. 6A and 6B, a 17 GHz PBG cavity 100 has been designed using the SUPERFISH code and has been tested on a vector network analyzer. The Q-factor and the shunt impedance of the cavity 100 have been calculated.

The advantages of using the PBG cavity 100 include the variety of coupling schemes that can be implemented. The cold test was modeled using the HFSS code, and good agreement was found. The cavity 100 was undercoupled as designed. However, the coupling could be corrected when some rods were partially withdrawn, to obtain critical coupling.

Gyrotron oscillators and amplifiers have made great progress in recent years. The best results of gyrotron amplifiers have been obtained in the fundamental mode of circular waveguide, namely the $TE_{11}$ mode. In a single mode guide, mode competition and mode conversion are eliminated since higher order mode are cut off and cannot propagate. However, the excellent results obtained in the $TE_{11}$ mode cannot be extended to higher frequencies (~100 GHz) because the waveguide structure would be too small. In gyrotron oscillators, successful operation can be obtained in overmoded cavities if careful techniques of cavity design are used together with placement of the electron beam at the optimum radius for the desired mode. However, at very high frequency, mode competition is still a major issue for gyrotron oscillators. For devices in which mode competition is a limiting factor, the PBG cavity is advantageous, especially at moderate power levels.

The electromagnetic radiation in a gyrotron is produced by the interaction of a mildly relativistic gyrating electron beam and a TE wave close to cutoff in a cavity resonator. The oscillation frequency is given by:

$$\omega^2/c^2=k^2=k^2\perp=+k^2_z, \tag{6}$$

where, $k\perp$ and $k_z$ ($=q\pi/L<<k\perp$) are the transverse and longitudinal propagation constants of the $TE_{mnq}$ wave in the cavity of length L and q is an integer. The dispersion relation which determines the excitation of the cyclotron instability is:

$$\omega-k_z\beta_{z0}c=sw_{c0}/\gamma \tag{7}$$

where, $\omega_{c0}(=eB_0/m_e)$ is the cyclotron frequency, $\gamma=(1-\beta^2_{z0}-\beta^2\perp_0)^{-1/2}$ is the relativistic mass factor, $\beta\perp_0$ and $\beta_{z0}$ are respectively, the transverse and longitudinal velocities of the electrons normalized to the velocity of light, s is the cyclotron harmonic number and $B_0$ is the magnitude of the static axial magnetic field.

The beam parameters, the cavity dimension and an optimum detuning can be determined to optimize the interaction efficiency. The choice of the operating mode is dictated by the cavity ohmic heat capacity and the window for stable single mode excitation at a high interaction efficiency. It is often noticed in gyrotrons that while optimizing the detuning of the magnetic field to increase the interaction efficiency, the device slips into a different mode ("mode hops") if the excitation conditions for the latter mode are satisfied. This mode hopping in a high mode density cavity prevents the access of the high efficiency operating regime of the design mode.

Traditional gyrotron cavities are cylindrical copper cavities with a downtaper to cutoff at the entrance for mode confinement and an uptaper at the exit for output coupling. These cavities need to be overmoded to be sufficiently large to keep the cavity ohmic load to below about 2 $kW/cm^2$, which is a limit imposed by conventional cooling technology. In the present invention the cylindrical outer copper wall is replaced with a PBG structure.

Figure 7B:
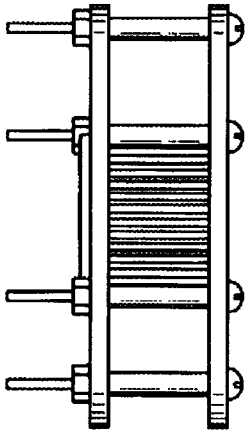
FIGS. 7A and 7B are photographs showing an embodiment of a 140 GHz PBG cavity having a periodic triangular lattice, in perspective and side views, respectively.
Figure 7A:
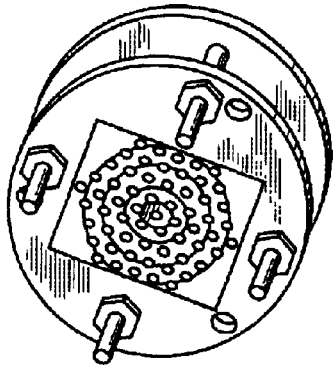

A 140 GHz PBG cavity 100 is constructed of two oxygen free high conductivity (OFHC) copper endplates perforated with 121 holes in a periodic triangular lattice, as shown in FIGS. 7A and 7B. The spacing between the adjacent rows of rods in the horizontal direction is 1.76 mm and in the vertical direction is 1.02 mm. 102 OFHC copper rods of 1/16 inch diameter are placed in the outer holes. A small hole in the center of the first (entrance) endplate formed the cut-off section of the cavity 100 while a larger hole in the second (exit) endplate was used to extract the electromagnetic radiation from the cavity 100 through diffraction. The entire structure is held together with mechanical fasteners such as bolts and nuts. If the fasteners are far enough away from the active portion of the PBG structure, the fasteners can be made of metal. If the fasteners are likely to be close enough to the PBG structure to affect the fields therein, the fasteners can be made of an insulator such as Nylon, Teflon or ceramic materials. Ceramic screws and nuts are known, and can be purchased from Ceramco, Inc. of Center Conway, NH.

Figure 8A:
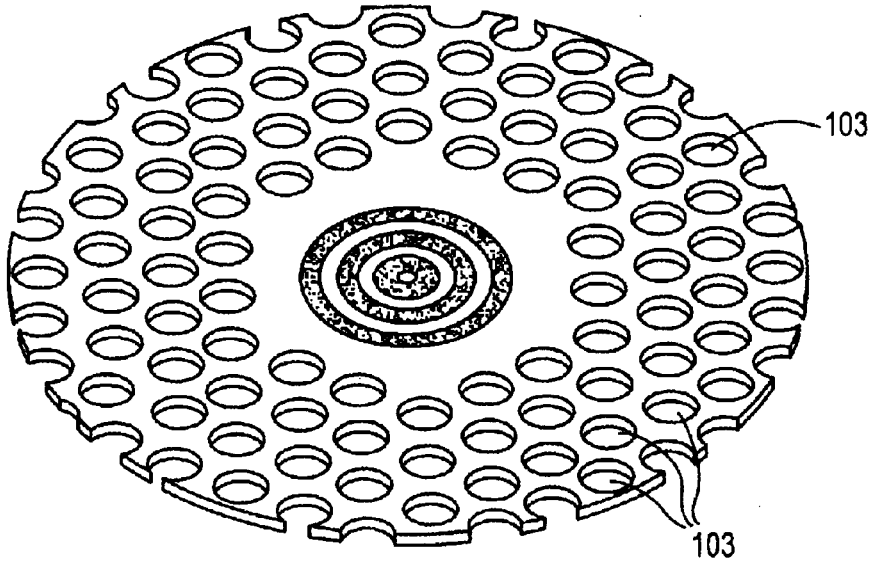
FIG. 8A shows a perspective drawing of the HFSS model of an embodiment of the 140 GHz photonic bandgap gyrotron cavity, according to principles of the invention.
Figure 8B:
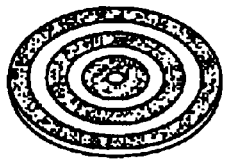
FIG. 8B shows a mode structure for the embodiment of the photonic bandgap gyrotron cavity that resembles the $TE_{031}$-like mode of a conventional cylindrical cavity and having a frequency of 139.97 GHz, according to principles of the invention.

A higher order TE-like waveguide mode can exist in this cavity if its resonant frequency lies in the stopband (bandgap) of the PBG structure. The bandgap can be adjusted such that the resonant frequencies of all other modes lie in the passband of the lattice and hence can leak through the array that acts like a transparent wall at those frequencies. Initial lattice dimensions were chosen using an analytic theory, and simulations in SUPERFISH and simulations using HFSS helped refine these dimensions. In FIG. 8A, a perspective view of the HFSS model of the PBG gyrotron cavity 100 is shown. In FIG. 8A, an empty circle 103 designates the location of each conductive rod or member 102, corresponding to the absence of electric field at that location, since no field exists within the conductor. The array can hold 121 rods but the 19 innermost rods (e.g., in an hexagonal array, the center rod and the next two layers of the hexagonal array surrounding the central rod, comprising 6 and 12 rods, respectively) have been omitted to form the cavity. The illustrative embodiment comprises three full hexagonal layers, and all but the rods at the six (6) vertex positions of the fourth, outermost, hexagonal layer. The frequency of the confined eigenmode shown in the model is 139.97 GHz and the mode structure resembles the $TE_{031}$-like mode of a conventional cylindrical cavity, which is shown in FIG. 8B. The other neighboring eigenmodes, being in the passband of the lattice, suffer significant losses due to the transparent cavity wall. Radiation that passes through the array propagates out and is not reflected back into the lattice. This feature of this novel gyrotron cavity is designed to permit strong single mode operation in the $TE_{031}$-like mode.

The cavity 100 need not necessarily comprise an array of metal rods. In an alternative embodiment, it can be an array comprising either natural or synthetic dielectric material or a combination of dielectrics and metals.

Figure 9:
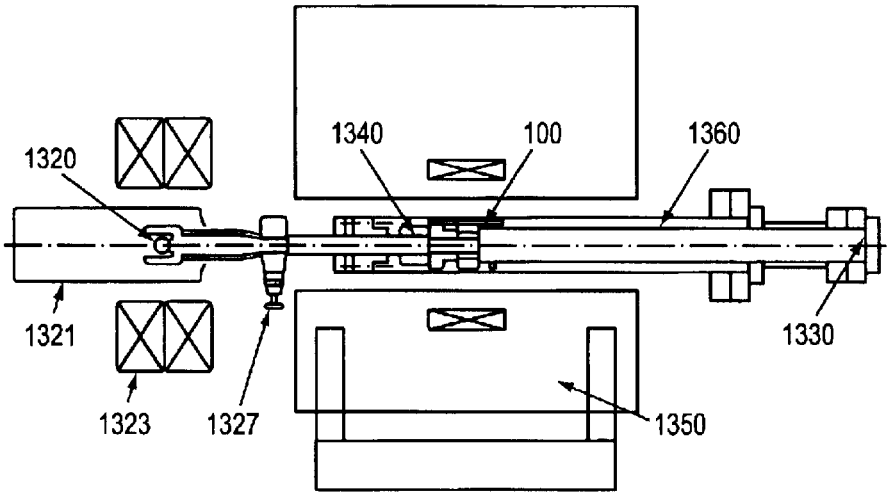
FIG. 9 is a diagram that shows the arrangement of an embodiment of the gyrotron oscillator device with the photonic bandgap structure ("PBG gyrotron oscillator") in a 140 GHz operating environment, according to principles of the invention.

The 140 GHz cavity described above was tested in actual operation in an electron beam system shown in FIG. 9. FIG. 9 is a diagram that shows the arrangement of the gyrotron oscillator device with the PBG structure ("PBG gyrotron oscillator") 100 in an operating environment, and omits pumping ports and various diagnostic features. A hollow annular electron beam is produced at an emitter 1320 of a magnetron injection gun (MIG) 1321, which is separated from the remainder of the apparatus by a gate valve 1327. The electron beam is controlled and focussed within the MIG 1321 by gun magnets 1323. The electron beam was guided through the PBG cavity 100 immersed in a 5.4 Tesla (T) magnetic field provided by a superconducting magnet 1350. The electron beam traverses the PBG cavity 100 passing through the holes in the endplates. The spent electron beam emerging from the cavity 100 after interaction was collected by a steel pipe which also served as a waveguide to transport the electromagnetic radiation from the cavity 100 to the window 1330 of the gyrotron. The electron beam propagates in a beam tunnel 1340. Stray electrons are collected by a collector 1360 situated at the downstream end of the beam tunnel 1340.

Figure 10:
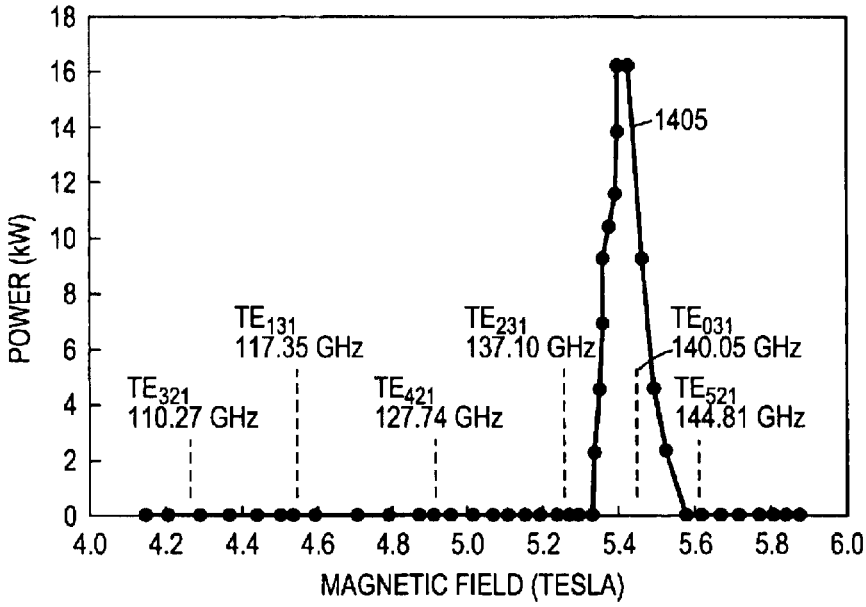
FIG. 10 is a diagram that shows the variation of output power with magnetic field for an embodiment of the 140 GHz gyrotron oscillator device with the photonic bandgap structure, according to principles of the invention.

In order to test the PBG gyrotron oscillator for mode selectivity, the device was operated at 68 kV, 5 A over the magnetic field range of 4 to 6 T. This range in magnetic field tuning corresponds to a range of frequency tuning, of about 40% centered about the desired operating frequency. FIG. 10 is a diagram that shows the variation of output power with magnetic field in an embodiment of the gyrotron oscillator device with the photonic bandgap structure. The mode 1405 with an operating frequency of 140.05 GHz ($TE_{031}$) is the only strong mode emanating from the cavity. Angular scans of the output radiation were used to verify that the 140 GHz mode is a $TE_{03}$—like mode. This result is direct confirmation of the mode selectivity of the PBG cavity. FIG. 10 also shows the positions, along the horizontal axis, in both units of magnetic field and frequency, of five modes that are substantially absent from the output beam. These competing modes are indicated as modes at 110.27 GHz ($TE_{321}$), 117.35 GHz ($TE_{131}$),127.74 GHz ($TE_{421}$), 137.10 GHz ($TE_{231}$), and 144.81 GHz ($TE_{521}$).

At magnetic field values away from the operating mode, the gyrotron oscillator has weak emission in other modes. Since the calorimeter used in the magnetic field scan of FIG. 10 could not measure power below 1 kW, a calibrated diode was used to estimate the power of the weak, parasitic modes. The diode measurements confirmed that the power in the points shown as 0 kW in FIG. 10 was everywhere less than 100 W, corresponding to at least 22 dB down from the main mode. Observation of weak modes in a gyrotron oscillator is rather common and is usually due to excitation of modes in the beam tunnel before the cavity or in the output structure after the cavity. By changing these structures in our experiment and observing a change in the frequency and output power of the observed weak modes, we conclude that they are due to the surrounding structures and not due to the PBG cavity.

The present results may be compared to the corresponding results for a conventional $TE_{031}$ mode cylindrical cavity gyrotron. Of particular concern in the extensively studied conventional $TE_{031}$ mode cylindrical cavity gyrotron is the mode hopping to the $TE_{231}$ mode which prevents the access to the high efficiency regime of the $TE_{031}$ mode. In a PBG gyrotron the absence of the $TE_{231}$ mode leads directly to the possibility of attaining the maximum possible efficiency in the design mode, the $TE_{031}$ mode.

The operating parameters for the power vs magnetic field scan shown in FIG. 10 were chosen to permit beam transmission without significant interception or reflection over the whole range of the magnetic field values. The maximum power recorded in the design mode for the operating voltage and current used for the magnetic field scan is about 16 kW. By further optimizing the design mode, a peak power of 25 kW was recorded at an efficiency of 7%. The observed efficiency is somewhat lower than the efficiency obtained in optimized cylindrical cavity gyrotrons. This can be explained as a result of the design of the PBG cavity input and output structures. For convenience, in these observations, we have used a flat plate with a hole for output coupling. This hole coupling results in a high cavity (diffraction) Q compared with the cavity ohmic Q, thus trapping too much of the generated power inside the cavity.

PBG cavities with more highly optimized output coupling are possible. In conventional gyrotrons, output coupling is taken along the axis of the device, so called axial output coupling. As has been indicated herein, the PBG cavity has the valuable feature that it can be used with either axial or transverse output coupling. Transverse coupling is accomplished by removing some of the rods in the outer rows of the PBG structure to allow some of the power to propagate out transversely and then building a coupler to confine and transport that radiation. Excellent results on transverse coupling into and out of a PBG structure were obtained in a test structure at 17 GHz. Transverse coupling can assist in extending gyrotron operation to very high frequencies, into the submillimeter wave band. At very high frequencies, gyrotron efficiency is limited by the low ohmic Q of copper cavities which scales as $\omega^{1/2}$ and requires a low output (or diffractive) cavity Q for high output efficiency to be achieved. For high interaction efficiency, cavities must be relatively long, of order ten wavelengths or more. With axial output coupling, the cavity Q scales as $(L/\lambda)^2$, with L the cavity length, resulting in cavities with very high Q and a low overall efficiency. Transverse coupling, possible with the PBG cavity, can yield a low cavity Q even in a long cavity. This can provide high efficiency operation at submillimeter wavelengths.

The successful demonstration of mode selective gyrotron oscillations in an overmoded gyrotron cavity is a very promising development for a variety of microwave tubes including the conventional slow wave devices such as traveling wave tubes, as well as gyrotron oscillators, gyroklystrons and the gyrotron traveling wave tubes (gyro-TWTs). Of particular interest are the ongoing efforts to build a 100 kW gyrotron traveling wave amplifier at 94 GHz. One of the main threats to the zero drive stability of the gyro-TWT is the backward wave oscillation (BWO) that can propagate in the interaction structure. However, a gyro-TWT with a PBG interaction structure can be designed such that the BWO frequency lies in the passband of the lattice thus dramatically reducing the quality factor of the BWO mode in the interaction structure. Elimination or reduction of the intensity of the BWO can permit operation of the gyro-TWT at higher beam currents and hence higher output powers.

The PBG cavity is very useful in gyrotron oscillator applications at moderate average power levels. However, the rods of the PBG structure may not be able to dissipate as high an average power level as the smooth walls of conventional cylindrical cavities. This can be mitigated by using thicker rods and by cooling the rods with water (or another coolant) flowing through channels in the center of each rod. The PBG structures are able to handle high peak power levels. They are particularly well suited to high peak power, moderate average power level amplifiers. They are also very attractive for use as the buncher cavities in amplifiers at any power level. At very high frequencies, where moderate power levels are of interest, the PBG structures are also very attractive.

Another potential application is a conventional klystron or coupled cavity traveling wave tube operating in a higher order mode with a PBG cavity. This can provide a portable source or amplifier at high power (>10 kW), at frequencies above 100 GHz.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A tunable photonic bandgap structure, comprising a mode-selective photonic bandgap structure having a plurality of members, wherein at least one member is movable and wherein at least one member comprises metal, the photonic bandgap structure controlling electromagnetic radiation from a charged particle beam.

2. The tunable photonic bandgap structure of claim 1, wherein at least one of the plurality of movable members comprises a rectilinear structure.

3. A temperature-controlled photonic bandgap structure, comprising a mode-selective photonic bandgap structure having a plurality of members, wherein at least one member is temperature controlled.

4. The temperature-controlled photonic bandgap structure of claim 3, wherein said at least one temperature-controlled member comprises a surface that is temperature controlled by contact with a fluid.

5. A tunable, temperature controlled photonic bandgap structure, comprising a mode-selective photonic bandgap structure having a plurality of members, wherein at least one member is movable, and wherein at least one member is temperature controlled.

6. The photonic bandgap structure of claim 5, wherein said photonic bandgap structure comprises said plurality of members disposed in a multi-dimensional array.

7. The photonic bandgap structure of claim 6, wherein said multi-dimensional array is a periodic array.

8. An apparatus for providing mode-selected microwave radiation, comprising:

a vacuum electron device microwave generator creating microwave radiation having a plurality of modes; and a temperature controlled photonic bandgap structure in communication with the vacuum electron device microwave generator to receive the microwave radiation and to select one of the plurality of modes of the microwave radiation to be propagated, said photonic bandgap structure comprising a plurality of members disposed in a two-dimensional array wherein at least one member is temperature controlled.

9. An apparatus for providing mode-selected microwave radiation, comprising:

a vacuum electron device microwave generator creating microwave radiation having a plurality of modes; and a tunable photonic bandgap structure in communication with the vacuum electron device microwave generator to receive the microwave radiation and to select one of the plurality of modes of the microwave radiation to be propagated, said photonic bandgap structure comprising a plurality of members disposed in a two-dimensional array wherein at least one member is movable.

10. An apparatus for providing mode-selected microwave radiation, comprising:

a vacuum electron device microwave generator creating microwave radiation having a plurality of modes; and a tunable photonic bandgap structure in communication with the vacuum electron device microwave generator to receive the microwave radiation and to select one of the plurality of modes of the microwave radiation to be propagated, said photonic bandgap structure comprising a plurality of members disposed in a two-dimensional array wherein at least one member is movable, and wherein at least one member is temperature controlled.

11. An apparatus for providing mode-selected microwave radiation, comprising:

a microwave generator means for creating microwave radiation having a plurality of modes; and a temperature controlled photonic bandgap means for receiving the microwave radiation and for selecting one of the plurality of modes of the microwave radiation to be propagated, said temperature controlled photonic bandgap means in communication with the microwave generator means.

12. An apparatus for providing mode-selected microwave radiation, comprising:

a microwave generator means for creating microwave radiation having a plurality of modes; and a tunable photonic bandgap means for receiving the microwave radiation and for selecting one of the plurality of modes of the microwave radiation to be propagated, said tunable photonic bandgap means in communication with the microwave generator means.

* * * * *

UNITED STATES PATENT AND TRADEMARK OFFICE

CERTIFICATE OF CORRECTION

PATENT NO. : 6,801,107 B2
APPLICATION NO. : 10/037661
DATED : October 5, 2004
INVENTOR(S) : Chen et al.

It is certified that error appears in the above-identified patent and that said Letters Patent is hereby corrected as shown below:

Please replace the paragraph at column 1, line 12 with the following paragraph:

GOVERNMENT RIGHTS

This invention was made with Government support under Grant Nos. 99RA0734-01 and F49620-00-1-0007, awarded by the US Air Force. The Government has certain rights in this invention.

Signed and Sealed this
Tenth Day of May, 2011

David J. Kappos

David J. Kappos
*Director of the United States Patent and Trademark Office*